US005466178A

United States Patent [19]

Inman, Sr. et al.

[11] Patent Number: 5,466,178

[45] Date of Patent: Nov. 14, 1995

[54] LOAD-RELIEVING EXTERNAL STEERING SYSTEM FOR MARINE OUTDRIVE UNITS

[75] Inventors: Frederick R. Inman, Sr.; Frederick R. Inman, Jr., both of Glendora, Calif.

[73] Assignee: Inman Marine Corporation, San Dimas, Calif.

[21] Appl. No.: 339,961

[22] Filed: Nov. 15, 1994

[51] Int. Cl.[6] ..... B63H 20/12

[52] U.S. Cl. ..... 440/61; 114/150

[58] Field of Search ..... 440/57, 61, 53, 440/900; 114/150

[56] References Cited

U.S. PATENT DOCUMENTS

| | | | |
|---|---|---|---|
| 2,939,417 | 6/1960 | Hammock, Sr. | 114/150 |
| 3,913,517 | 10/1975 | Lohse et al. | 440/61 |
| 4,645,463 | 2/1987 | Arneson | 440/57 |
| 4,775,342 | 10/1988 | Connor et al. | 440/61 |

*Primary Examiner*—Sherman Basinger
*Attorney, Agent, or Firm*—Christie, Parker & Hale

[57] ABSTRACT

A load-relieving external steering system for marine outdrive units comprises a first hydraulic steering ram having a piston partially disposed within a housing, wherein the piston is attached to one side of an outdrive unit and the housing is attached to an adjacent portion of a transom. A second hydraulic steering ram has a piston partially disposed within a housing, wherein the piston of the second steering ram is attached to an opposite side of the outdrive unit and the housing of the second steering ram is attached to an adjacent portion of the transom. The first and second steering rams are mounted in a common horizontal plane between the outdrive unit and transom. The housing of each steering ram comprises a front chamber and a rear chamber. A hydraulic pump for providing hydraulic fluid at a constant pressure is connected to the rear chamber of each steering ram. A hydraulic pump and a control valve for providing hydraulic fluid at a variable pressure is connected to the front chamber of each steering ram, wherein the hydraulic pressure at a variable pressure is routed to a particular front chamber to effect the steering of the vessel in a desired direction. At all times the hydraulic fluid at constant pressure routed to each rear chamber imposes a frontwardly directed compression force onto an upper steering bearing to counteract a static and/or dynamic tension load and, thereby enhance the service life of the upper steering bearing.

23 Claims, 6 Drawing Sheets

LOAD-RELIEVING EXTERNAL STEERING SYSTEM FOR MARINE OUTDRIVE UNITS

FIELD OF THE INVENTION

This invention relates to an external steering system for marine outdrive units and, more specifically, to an external steering system capable of relieving both static and dynamic loads imposed on structural members used to attach such outdrive units.

BACKGROUND OF THE INVENTION

Outdrive units are used with in-board motored vessels to transmit the rotational motion of the in-board motor within the vessel to rotational motion of a propeller outside the vessel and immersed in the surrounding water. The in-board motor is coupled to the outdrive unit by a drive shaft having a conventional U-joint at each end connected to a yoke of the motor at one end and a yoke of the outdrive unit at the other. The drive shaft passes from the motor through the transom at the rear of the vessel, through a mounting plate attached to the transom, through a drive shaft bell housing assembly attached to the plate via a gimbal ring, and to the outdrive unit. The bell housing assembly is attached to the plate via the gimbal ring at an upper steering bearing and a lower steering bearing that are arranged at vertical locations to accommodate right and leftward movement of the outdrive unit vis-a-vis the transom and, thus effect steering of the vessel. The degree to which the outdrive unit is immersed into the water, and the placement of the outdrive into a retracted portion for transporting, i.e., the vertical placement of the outdrive unit vis-a-vis the transom via a horizontal tilt axis of the gimbal ring, is controlled by a hydraulically operated tilt ram mounted between the outdrive unit and gimbal ring.

The conventional steering system used with the outdrive unit comprises a manually operated steering control, such as a steering wheel and the like, that transmits a steering command via a cable mechanism to a hydraulically operated steering control valve mounted within the vessel adjacent to and parallel with the transom. A piston extends from the control valve and is connected at one end to a tiller lever that extends through an opening in the transom, through the mounting plate and is connected at an opposite end to the gimbal ring. The control valve effects the inward and outward movement of the piston parallel to the transom according to respective leftward and rightward movement of the steering wheel. The inward and outward movement is translated by the tiller lever to steering movement of the outdrive unit.

When the outdrive unit is not operating with the motor lowered into the water, the weight of the outdrive unit, due to the placement of the unit rearward of the transom, imposes a rearwardly directed tension force on the upper steering bearing from the fulcrum action of the tilt rams. A frontwardly directed compression force is also imposed on the lower steering bearing. During the operation of the outdrive unit to propel the vessel, the tension force imposed on the upper bearing is increased due to the addition of a frontwardly directed dynamic force that is imposed on the bottom of the outdrive unit from the propulsion action of the propeller in the water. This static and dynamic tension force is unchecked by any structural member attaching the outdrive unit to the transom and frequently, if not usually, results in the failure of the upper steering bearing.

Due to the construction of the gimbal ring and the mounting plate and their relation to the outdrive unit, it is difficult to accommodate the destructive action of the tension force on the upper bearing by constructing a mounting plate having a structurally reinforced upper portion. The construction of such a reinforced mounting plate is precluded because of the need to keep the upper portion of the plate relatively small to accommodate the retracted positioning of the outdrive unit during transport. With respect to the lower steering bearing, the compression force that is imposed has not resulted in the same type of destructive action found in the upper bearing due in part to the nature of the lower portion of the mounting plate to better accommodate compressive forces. Additionally, unlike the upper portion of the plate, the lower portion can be structurally reinforced without impairing the vertical mobility of the outdrive unit.

It has been discovered that the efficiency of existing outdrive units, i.e. , gains in speed and acceleration, can be obtained by extending the outdrive unit a further distance rearward from the transom via the use of an extension unit. Outdrive extension units extend the outdrive unit approximately 8 to 9 inches rearward of the transom. The extension unit operates to increase the efficiency of the outdrive unit by revising the placement of the propeller relative to the vessel, namely, by placing the propeller in cleaner water less disturbed by the vessel hull, and improving the depth and attitude at which the propeller can be immersed in the water. This increases the action of the propeller against the water, thereby, increasing the speed of the vessel.

However, the use of an extension unit with the outdrive unit aggravates the existing problem with respect to the load carried by the upper steering bearing by approximately doubling both the static and dynamic tension forces that are imposed on the upper steering bearing. This loading force results in increased incidents of upper bearing failure.

It is, therefore, desirable that an apparatus be constructed that will counteract and minimize the static and dynamic tension forces imposed on the upper steering bearing used to connect an outdrive unit to its mounting plate to minimize damage caused by such forces and, thereby enhance the life of the upper steering bearing. It is desirable that the apparatus be capable of use with both existing outdrive units and with outdrive units incorporating an outdrive extension unit without significant modification and in a manner that facilitates easy installation. It is desirable that the apparatus be capable of minimizing the damage caused to the upper steering bearing in a manner that does not affect the vertical movement of the outdrive unit and does not adversely affect the efficiency or performance of the outdrive unit.

SUMMARY OF THE INVENTION

This invention addresses and fulfills the needs identified above. It does so by providing an external steering system for a marine outdrive unit that is operated in a manner imposing a constant forwardly directed force on the outdrive unit to counteract the static and/or dynamic tension loads imposed on the upper steering bearing that connects the outdrive to a transom of the vessel.

Generally speaking, in terms of structure the external steering system comprises a first steering ram having a piston partially disposed within a housing. The housing comprises a front hydraulic chamber and a rear hydraulic chamber. The piston is pivotally mounted to a mounting bracket located at one side of a marine outdrive unit. The housing is pivotally mounted to an adjacent portion of a transom at the rear of the vessel. The external steering system comprises a second steering ram comprising a piston partially disposed within a housing, wherein the housing comprises front and rear hydraulic chambers. The piston of the second steering ram is pivotally mounted to a mounting bracket located at an opposite side of the outdrive unit. The housing of the second steering ram is pivotally mounted to an adjacent position of the transom. The first and second rams are mounted in substantially horizontal positions between the outdrive unit and the transom.

The first and second steering rams are hydraulically operated to effect rightward and leftward movement of the outdrive unit by a hydraulic system that includes means for providing hydraulic fluid at a constant pressure to the rear chamber of each steering ram, and means for providing hydraulic fluid at a variable pressure to the front chamber of each steering ram depending on the desired direction of steer. The hydraulic fluid applied to the rear chamber of each steering ram at constant pressure imposes a frontwardly directed force on a upper steering bearing used to connect the outdrive unit to the transom of the vessel. This frontwardly directed compression force serves to counteract a rearwardly directed static tension load imposed by gravity from the weight of the outdrive unit on the upper steering bearing. Depending on the particular preset amount of constant pressure, the frontwardly directed compression force can also counteract rearwardly directed dynamic tension loads imposed on the upper steering bearing by the propulsion thrust force acting on the propeller of the outdrive unit. In this manner, the external steering system serves to reduce the tension load on the upper steering bearing and, thereby increase the operating life of the same.

The external steering system constructed according to principles of this invention can be used either with or without an outdrive extension unit interposed between the transom and outdrive unit. The external steering system is configured to use existing means for providing hydraulic fluid that are used to accommodate steering of marine outdrive units using a conventional internal-type steering system.

BRIEF DESCRIPTION OF THE DRAWINGS

The above-mentioned and other features of this invention are set forth in the following detailed description of the presently preferred and other embodiments of the invention, which description is presented with reference to the accompanying drawings wherein.

DETAILED DESCRIPTION

Figure 1:
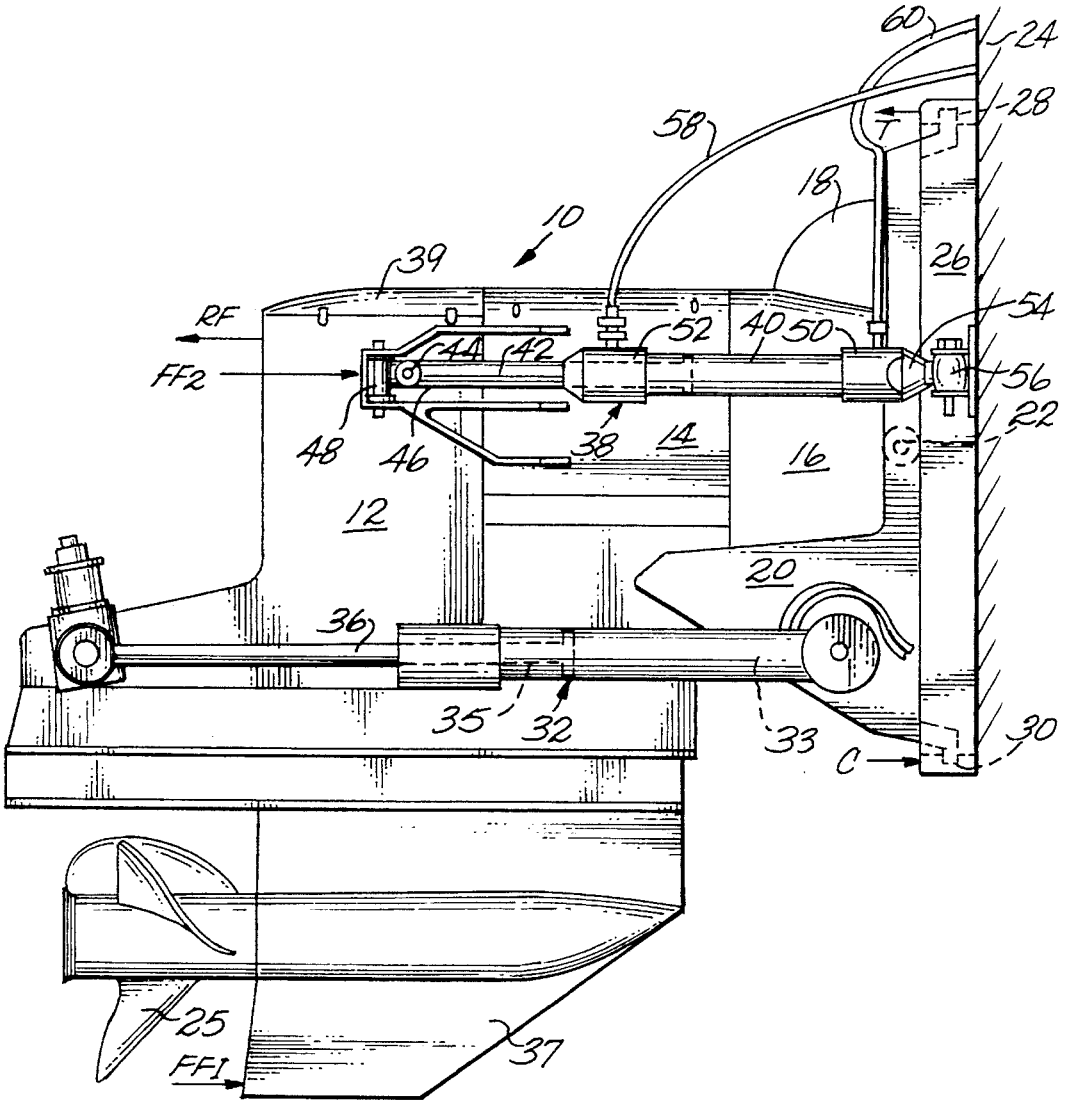
FIG. 1 is a side elevational view of a marine outdrive unit equipped with a preferred embodiment of a load-relieving external steering system constructed according to principles of this invention.
Figure 2:
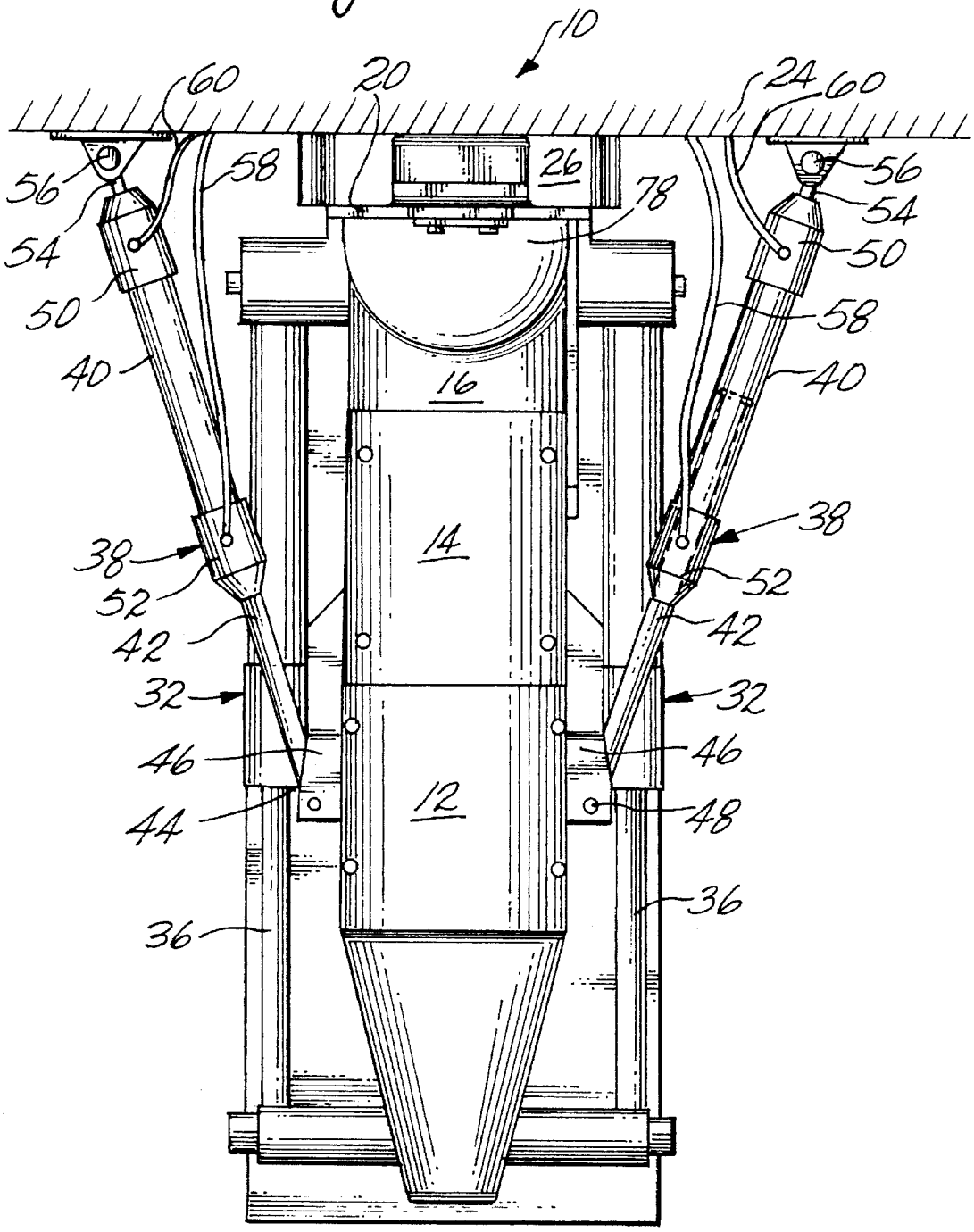
FIG. 2 is a top plan view of the load-relieving external steering system of FIG. 1.

A marine outdrive unit is used to transfer rotational motion of an internal combustion engine crankshaft positioned within a vessel to rotational motion of a propeller positioned outside of the vessel and submerged a distance below the surface of the water. A preferred embodiment of a load-relieving external steering system 10 constructed according to principles of this invention is shown in FIGS. 1 and 2. An outdrive unit 12 is connected to an extension unit 14 which is connected to a bell housing assembly 16. The bell housing assembly comprises a bell-shaped drive shaft housing 18 and a gimbal ring 20. The extension unit 14 is connected to the rear end of the housing assembly 16 which is connected at an opposite end to the gimbal ring 20. The housing assembly is connected to the gimbal ring at two horizontally opposed mounting positions 22 that serve as a pivot axis to accommodate vertical upward and downward pivoting movement of the outdrive unit 12 vis-a-vis a vessel transom 24 for purposes of both adjusting the degree of propeller 25 submergence into the water and for accommodating retraction (elevation) of the outdrive unit, as for highway transportation.

The gimbal ring 20 is attached to a mounting plate 26 at an upper steering bearing 28 and a lower steering bearing 30 that are arranged at vertically opposed locations. The mounting plate 26 is attached to the transom 24. The upper and lower steering bearings accommodate leftward and rightward movement of the outdrive unit vis-a-vis the transom to effect the steering of the vessel. In a broad sense, plate 26 and ring 20 can be viewed as a gimbal assembly which mounts outdrive 12 to transom 24 for relative movement between them about horizontal and substantially vertical axis.

As described above, the external steering system 10 as shown in FIGS. 1 and 2 comprises an extension unit 14 interposed between the outdrive unit 12 and the housing assembly 16. It is to be understood that, within the scope of this invention, an external steering system as constructed according to principles of this invention can be used with outdrive units which do not include an extension unit. However, for reasons that will be described below, the use of an outdrive extension unit presents an aggravated loading condition that greatly benefits from the use of this invention. It is for this reason that the external load-relieving steering system according to this invention is described and illustrated in conjunction with an outdrive unit comprising an extension unit.

Extension unit 14 enhances the operational efficiency of the outdrive unit by displacing the outdrive unit a predetermined further distance rearward of the transom. That rearward displacement of the outdrive increases the effective lever arm between the center of the propeller and the center of the gimbal ring; that lever arm is not actually straight because of the dual right-angle gearing arrangements within the outdrive unit, but can be viewed as a straight arm for purposes of analysis of forces. The increase in the length of the propeller-to-gimbal lever arm means that propeller immersion can be increased for a given angle of propeller axis relative to vessel length. Another benefit is that the propeller can develop more thrust at a given turns rate. The penalty paid for these benefits and improvements in vessel performance is that the loads on the gimbal ring bearings, notably the upper steering bearing, are increased as a consequence of a higher thrust reaction force being applied via a longer lever arm to the vessel via the mounting plate. A large amount of rearward displacement of the outdrive unit is not required to achieve the desired advantages afforded by such extension; a typical extension unit may have a length in the range of from 6 to 10 inches.

Referring to FIGS. 1 and 2, tilt rams 32 are connected at one end to each opposite side of the outdrive unit 12 near a center position of the outdrive unit and are connected at an opposite end to adjacent locations in the lower portion of the gimbal ring 20. The tilt rams are hydraulically operated to control the vertical movement of the outdrive unit about the horizontal mounting points 22. The tilt rams can be operated to provide a desired degree of immersion of the propeller 25 which is rotated by the outdrive unit, and can be operated to place the outdrive unit in a fully retracted position, i.e., with the propeller completely removed from the water, for purposes of transporting the vessel in a carrier and the like on the highway. For example, upward movement of the outdrive unit 12 is provided by routing hydraulic fluid at a predetermined pressure to a front chamber 33 of each tilt ram 32, causing the outward displacement of pistons 36 and the upward rotation of a bottom portion 37 of the outdrive unit 12 about the horizontal mounting points 22 which form a tilt axis. Downward movement of the outdrive unit is provided by bleeding the hydraulic fluid from the front chambers 33 and, if desired, simultaneously routing hydraulic fluid at a predetermined pressure to rear chambers 35 of each tilt ram, causing the inward displacement of the pistons 36 and the downward rotation of the bottom portion 37 of the outdrive unit. During steady-state operation of the vessel, the tilt ram front and rear chambers are sealed to maintain the outdrive unit at a desired vertical position and, thus at a predetermined degree of propeller immersion.

The outdrive unit described above and illustrated in FIGS. 1 and 2 represents a conventional marine outdrive manufactured by a well known outdrive manufacturer such as Brunswick/Mercury and is popular among a large number of boating enthusiasts. Although such an outdrive unit is indeed popular, it is not without its problems; namely, premature wear and ultimate failure of the upper steering bearing 28. The placement of the outdrive unit rearward of its mounting points to the mounting plate, i.e., the upper and lower steering bearings, creates a moment between the center of gravity of the outdrive unit and such steering bearings. This moment imposes a rearwardly directed static tension load T on the upper steering bearing 28, and a forwardly directed static compression load C on the lower steering bearing 30. Accordingly, the deadweight of the outdrive unit itself produces a downwardly acting sheer load on the steering bearings 28 and 30.

The use of the extension unit 14 interposed between the outdrive unit 12 and the housing assembly 16 effects further rearward placement of the outdrive unit to take advantage of the above mentioned performance advantages. This revised rearward placement, however, increases the moment between the outdrive unit 12 and the steering bearing 28 and 30, approximately doubling the static tension T and compression C loads imposed upon the upper and lower steering bearings, respectively.

The compression and tension loads imposed upon the steering bearings are not well carried by the materials from which the mounting plate 26 is formed and, thus ultimately result in the failure of the steering bearings. The forwardly acting compression loads can be dealt with by suitable design of the gimbal ring 20 and the mounting plate 26, i.e., by providing structural reinforcement to the area surrounding the lower steering bearing 30. The rearwardly acting tension loads, however, can not be so easily addressed by providing structural reinforcement of the upper steering bearing because of the need to provide clearance from the rear edges of the gimbal ring 20 and the mounting plate 26 above the housing assembly 16 to permit the outdrive unit to be tilted upwardly about its horizontal pivot axis into its fully retracted position for highway transportation.

During the operation of the outdrive unit 12 to propel the vessel, dynamic rearwardly directed loads are imposed onto the upper and lower steering bearings due to forwardly directed forces FFI caused by propeller thrust to further aggravate the static tension and compression loads caused by the deadweight of the outdrive unit. The points of attachment between the outdrive unit and the tilt rams 32 define a fulcrum about which propeller thrust tends to rotate the bottom portion 37 of the outdrive unit 12 forward toward the vessel and a top portion 39 of the outdrive unit rearward away from the vessel. This rearwardly directed force RF acts to both aggravate the static tension load imposed on the upper steering bearing 28 and reduce the static compression load imposed on the lower steering bearing 30. Moreover, if propeller thrust is not constant, but varies cyclically, as obviously is the case when the propeller is experiencing varying degrees of submergence when the vessel runs in a wave train, those cyclic loads are superimposed upon the static loads to which the steering bearings are subjected.

Accordingly, because of the increased distance between the propeller 25 and the attachment point to the mounting plate 26, i.e., the existence of a longer moment arm, those cyclic loads have a greater adverse impact upon the steering bearings 28 and 30 when an extension unit 14 is used then would otherwise be the case. Superimposition of cyclic loading upon high level constant static loads is well nigh a worst case scenario for metal failure due to fatigue.

An external steering system constructed according to principles of this invention addresses and acts to counteract the difficult loading conditions upon the steering bearings, notably the upper steering bearing 28 used in conjunction with marine outdrive units. As shown in FIGS. 1 and 2, a preferred embodiment of a load-relieving external steering system for a marine outdrive unit comprises a pair of hydraulically operated steering rams 38 mounted to horizontally opposed sides of the outdrive unit. The steering rams 38 are mounted to the transom 24 and outdrive unit 12 at positions planar with (or substantially so) the horizontal mounting points 22 between the gimbal ring 20 and the plate 26, and vertically above the mounting locations of the tilt rams 32. IN FIG. 1, for clarity of the presentation, the steering rams are shown connected to the transom at locations above the tilt axis of the outdrive unit; in practice of the invention, however, the connection of the steering rams to the transom preferably is at the same height on the transom as the position occupied by the gimbal tile axis, and the effective location of connection of the rear ends of the steering rams to the outdrive may be somewhat lower than the locations shown in FIG. 2. The ideal geometry of the connection of the steering rams between the transom and the outdrive is one which allows the steering and tilt systems to be operated without effect upon each other.

Each steering ram comprises a housing 40 (cylinder) and a piston 42 disposed partially within the housing. A rear end portion 44 of each piston 42 is attached to a mounting bracket 46 integral with the extension unit by use of a pivoting fastener 48, which is capable of accommodating a predetermined amount of horizontal movement by the piston end 44 to produce rightward and leftward steering movement of the outdrive unit. Each housing 40 comprises a front hydraulic chamber 50 and a rear chamber 52. Each housing is mounted at a front end portion 54 to an adjacent portion of the transom 24 by use of a pivoting fastener 56 that accommodates both horizontal movement of the steering ram 38, to permit rightward and leftward steering movement of the outdrive unit, and vertical hinging movement of the steering ram as well, to permit vertical upward and downward movement of the outdrive unit in response to operation of the tilt rams.

The steering rams 38 are operated to offset the rearwardly directed tension load T imposed on the upper steering bearing 28 through the use of a hydraulic system that is described in greater detail below. Hydraulic fluid at a constant predetermined pressure is routed to and applied to the rear chamber 52 of each steering ram 38 via hydraulic transfer lines 58 to cause, or tend to cause, the inward displacement of each piston 42 within each respective ram housing. Because the hydraulic fluid routed to each rear chamber is at a constant pressure, the inward displacement of each piston 42 imposes a forwardly directed force FF2 on the outdrive unit 12 that serves to offset or relieve the rearwardly directed tension load T on the upper steering bearing 28. The pressure of the hydraulic fluid routed to each rear chamber 52 can be adjusted to offset the statically imposed tension load T and/or to offset any anticipated dynamically imposed tension load as well.

The outdrive unit is moved rightward or leftward by routing a hydraulic fluid at a predetermined variable pressure to the front chamber 50 of each steering ram 38 via hydraulic transfer lines 60. Accordingly, leftward movement (left steering movement) of the outdrive unit is effected by routing hydraulic fluid at a variable pressure to the front chamber 50 of the steering ram 38 mounted on the right side of the outdrive unit, causing the piston 42 of the right side steering ram to be displaced outwardly from the housing 40. Conversely, rightward movement (right steering movement) of the outdrive unit is effect by routing hydraulic pressure at a variable pressure to the front chamber 50 of the steering ram 38 mounted on the left side of the outdrive unit, causing the piston 42 of the left side steering ram to be moved outwardly from the housing 40.

During steering movement of the outdrive unit 12, the front chamber 50 of a designated steering ram receives hydraulic fluid at a variable pressure sufficient to overcome the constant pressure of hydraulic fluid routed to the rear chamber 52 of the designated steering ram, thereby to cause the outward displacement of the piston 42 from the housing 40 of the steering ram 38. The two rear chambers are hydraulically connected together in parallel by a hydraulic circuit having constant volume. Therefore, the hydraulic fluid displaced from the rear chamber of the designated steering ram is routed to the rear chamber of the non-designated steering ram so that a constant pressure is maintained at each rear chamber. The hydraulic system of the present invention is configured so that hydraulic fluid is not routed to the front chamber of the non-designated steering ram. Accordingly, the hydraulic fluid routed to the rear chamber of the non-designated steering ram will cause the piston of the non-designated steering ram to be retracted within the non-designated steering ram.

Under steady-state conditions, i.e., when the direction of the vessel is constant, hydraulic fluid is bled off and is not routed to the front chamber 50 of either steering ram 38. Rather, under steady-state conditions the position of the outdrive unit is fixed by the action of the hydraulic fluid at constant pressure in each rear chamber 52 acting to impose an equal forwardly directed force on each piston 42 on opposite sides of the outdrive unit 12. In this manner, the external steering system acts to both effect steering of the outdrive unit and to impose a load-relieving forwardly directed force FF2 onto the outdrive unit 12 to enhance upper steering bearing 28 life.

Figure 3:
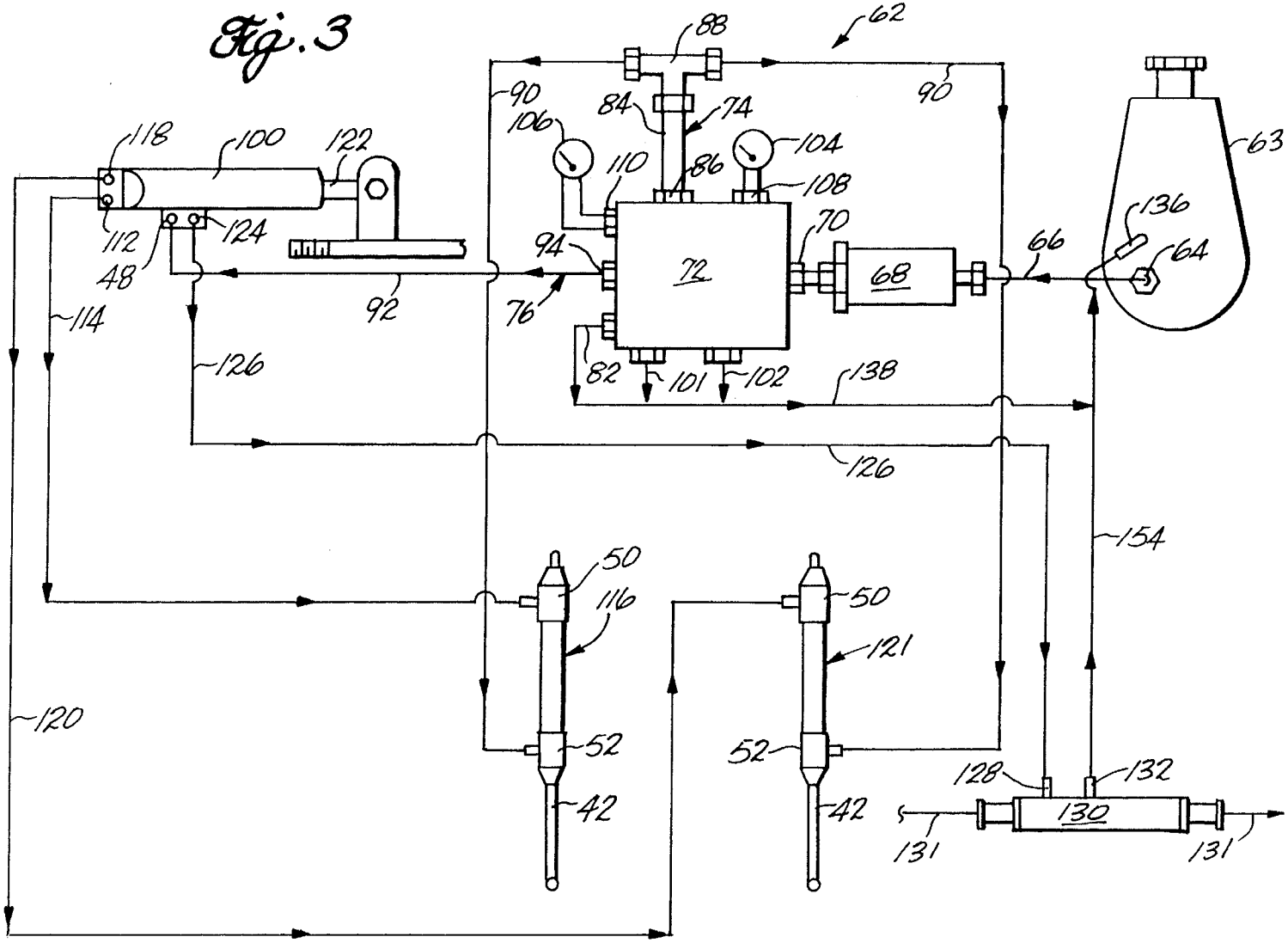
FIG. 3 is a schematic diagram of a hydraulic system for the load-relieving external steering system of FIGS. 1 and 2.

A schematic diagram of a hydraulic system 62 for a preferred embodiment of the load-relieving external steering system 10 of FIGS. 1 and 2 is shown in FIG. 3. Hydraulic fluid is stored in and brought to a predetermined operating pressure by a high-pressure hydraulic pump 63. In a preferred embodiment, the high pressure pump 63 is an automobile power steering pump that is belt driven by an inboard motor used to power the vessel. Hydraulic fluid from the pressure side 64 of the pump is routed by hydraulic transfer line 66 to a filter 68 for the removal of particulate matter. The filter may be a conventional in-line filter compatible with use in hydraulic service. The outlet end of the filter is routed to a first inlet 70 of a sequence relief circuit manifold 72.

Figure 4:
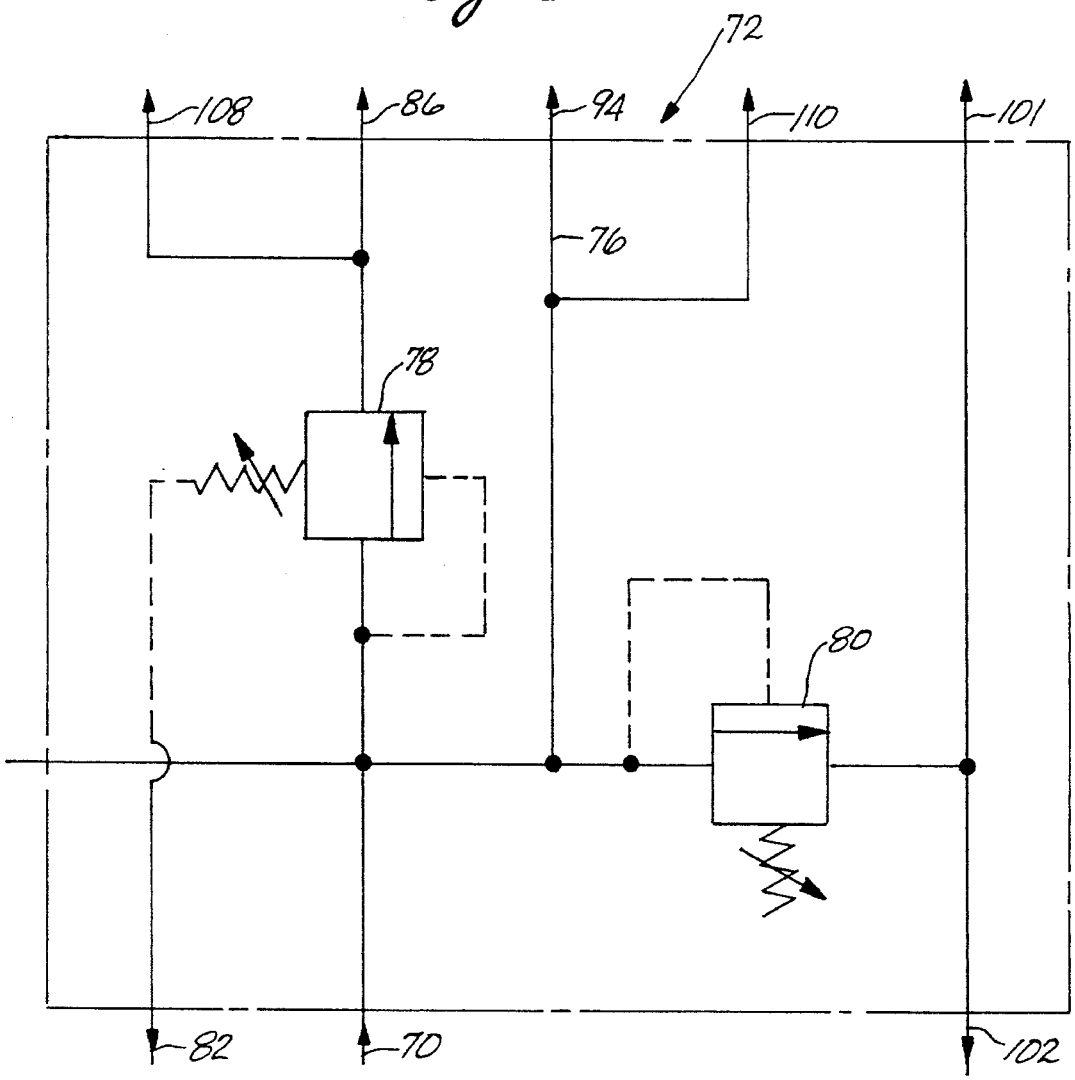
FIG. 4 is a schematic diagram of a sequence relief circuit manifold used in conjunction with the load-relieving external steering system of FIGS. 1–3.

As shown in FIG. 4, the sequence manifold 72 comprises a machined block of metal having a number of hydraulic cavities disposed therein to provide the desired inlets and outlets needed to split the entering high-pressure hydraulic fluid into two different hydraulic circuits; namely, a first circuit 74 that operates the rear chamber 52 of each steering ram 38 and a second circuit 76 that operates the front chamber 50 of each steering ram 38. The sequence relief valve also comprises check valves 78 and 80 in the form of cartridge valves that are preset at predetermined pressures to ensure that the hydraulic pressure routed to either the first or second circuit does not exceed the preset pressure. In a preferred embodiment, the sequence manifold comprises a first cartridge valve 78 that is preset to open or relieve pressure at 600 psig. Accordingly, once the hydraulic fluid entering the manifold 72 from the first inlet 70 reaches 600 psig, the first cartridge valve opens to relieve pressure and discharges excess hydraulic fluid to a drain outlet 82.

Referring to FIGS. 3 and 4, the first hydraulic circuit 74 comprises a hydraulic transfer line 84 connected to a first outlet 86 in the sequence manifold. The first outlet 86 is configured within the sequence manifold 72 to receive hydraulic fluid routed from the first inlet 70 and is in line with the first cartridge valve 78. A tee fitting 88 is connected to the hydraulic transfer line 84 to accommodate parallel transfer of hydraulic fluid through hydraulic transfer lines 90 and to the rear chamber 52 of each steering ram 38. Lines 90 in FIG. 3 correspond to hydraulic hoses 58 shown in FIGS. 1 and 2.

The second hydraulic circuit 76 comprises a hydraulic transfer line 92 connected to a second outlet 94 in the sequence relief manifold 72. The hydraulic transfer line 92 is connected to an inlet port 98 of a steering control valve 100. As shown in FIG. 4, the second outlet 94 is hydraulically connected within the sequence relief valve with the first inlet 70 and the second cartridge valve 80. In a preferred embodiment, the second cartridge valve 80 is preset to open, or relieve hydraulic pressure, at 700 psig. Accordingly, if the pressure of the hydraulic fluid entering the sequence manifold via the first inlet 70, or the hydraulic fluid in either the first or second hydraulic circuits 74 and 76 exceeds 700 psig, the second cartridge valve 80 will open to relieve pressure to return outlets 101 and 102.

Accordingly, through the operation of the first and second cartridge valves 78 and 80, the pressure of the hydraulic fluid routed to the first and second hydraulic circuits 74 and 76 will not exceed 700 psig, and typically be in the range of from 600 to 700 psig. The reason that the pressure of the hydraulic fluid routed to the first and second circuits will not exceed 700 psig is that the use of two relief outlets 101 and 102, rather than a single outlet, ensures that a sufficient volume of hydraulic fluid will be purged from the sequence manifold over a short period of time to effect a rapid pressure decrease.

Pressure gauges 104 and 106 may be attached to the sequence manifold at third and fourth outlets 108 and 110, respectively. As shown in FIG. 4, the pressure gauge 104 connected to the third outlet 108 can be used to measure the pressure of the hydraulic fluid in the first hydraulic circuit 74, and the pressure gauge 106 connected to the fourth outlet 110 can be used to measure the pressure of the hydraulic fluid in the second hydraulic circuit 76.

The steering control valve 100 comprises a conventional spool-type control valve that is used with a conventional internal steering mechanism to effect steering of an outdrive unit by selective provision of hydraulic fluid at a variable pressure. Such a control valve is similar to a steering control valve used in an automobile. The steering control valve comprises a first outlet port 112 connected via a hydraulic transfer line 114 to the front chamber 50 of a first steering ram 116 mounted on the left side of the outdrive unit, and a second outlet port 118 connected via hydraulic transfer line 120 to the front chamber 50 of a second steering ram 121 mounted on the right side of the outdrive unit. (Lines 114 and 120 correspond to hose 60 shown in FIGS. 1 and 2.) An actuator 122 is connected to the steering control valve 100 and is used to cause the control valve to route hydraulic fluid at variable pressure to one of the two outlet ports 112 and 118. In a preferred embodiment, the actuator comprises a part of a conventional mechanically driven steering mechanism that is used to effect the actuation of the steering control valve in a conventional internal steering system for a marine outdrive unit. Specifically, the steering system can comprise a steering wheel (not shown) operated by the pilot of the vessel which activates a push-pull type cable mechanism (not shown) that is coupled to the actuator 122 of the steering control valve 100.

The steering control valve 100 comprises an outlet port 124 that is connected via hydraulic transfer line 126 to an inlet port 128 of a hydraulic fluid cooler 130. The cooler may be a conventional single pass-type heat exchanger similar to those used for automobile power steering systems and the like that uses air as a cooling medium 131. Alternatively, the cooler may comprise a heat exchanger that uses water or the like as a cooling medium. The cooler comprises an outlet port 132 that is connected via hydraulic transfer line 134 to a return inlet 136 of the hydraulic pump 63. Additionally, the drain outlet 82, and return outlets 100 and 102 from the sequence manifold 72 are also routed to the return inlet 136 via hydraulic transfer line 138.

The hydraulic pump 63, sequence manifold 72, filter 68, and steering control valve 100 are all mounted within the vessel so that the only components of the external steering system outside the vessel are the steering rams 38 and the associated hydraulic transfer lines attached to the front and rear chamber of each ram.

Referring to FIGS. 3 and 4, the load-relieving steering system is operated by starting the engine (not shown) used to power the vessel, causing the hydraulic pump 63 to route pressurized hydraulic fluid to the first inlet 70 of the sequence manifold 72 and into the first and second hydraulic circuits 74 and 76. The hydraulic fluid is routed through the manifold, out the first outlet 86, into the first hydraulic circuit 74, and into the rear chamber 52 of each steering ram 116 and 121. The hydraulic fluid in the first hydraulic circuit 74 is at constant pressure. In a preferred embodiment, the pressure in the first circuit is maintained at a pressure of at least 600 psig. Referring now to FIGS. 1 and 2, the constant hydraulic pressure in the rear chamber 52 of each steering ram imposes a frontwardly directed force FF2 on the outdrive unit 12 sufficient to offset the statically induced tension load T on the upper steering bearing 28. Minimizing the degree of static and dynamic tension load imposed on the upper steering bearing 28 is desired as it enhances the longevity of such bearing and reduces repair and/or replacement costs associated with the failure of the same.

Referring back to FIGS. 3 and 4, hydraulic fluid is also routed through the sequence manifold 72, out the second outlet 94, into the second hydraulic system 76 and into the inlet port 98 of the steering control valve 100. In a preferred embodiment, the pressure of the hydraulic fluid in the second hydraulic circuit is at least 600 psig. When the steering control valve is not activated via the actuator 122, i.e., the direction of the vessel is constant, the hydraulic fluid routed to steering control valve 100 is purged or vented from the valve via the outlet port 124 and returned to the return side 136 of the hydraulic pump 63. When the steering valve 100 is activated by the actuator, i.e., when a change is vessel direction is desired, the steering valve dispenses hydraulic fluid from either the first or second outlet port 112 or 118, to effect hydraulic fluid transfer to the front chamber 50 of either the first or second steering ram 116 or 121, respectively. Although the pressure of the hydraulic fluid routed to the particular front chamber of a particular steering ram is the same as the pressure of the hydraulic fluid routed to the rear chamber 52 of the same steering ram, the surface area of the front face of the piston at the rear end of the chamber is larger than that of the rear face of the piston at the front of the chamber due to the part of the piston (the piston rod) that is disposed within the rear chamber. Accordingly, the force exerted in the front chamber by the variable pressure supplied from the control valve 100 will be greater than the force exerted in the rear chamber so that outward displacement of the piston from the steering ram, and steering of the outdrive unit, can be effected.

For example, referring now to FIG. 3, to direct the vessel in the leftward direction the actuator 122 is moved to the desired direction, causing the control valve 100 to dispense hydraulic fluid, via outlet port 118 and hydraulic transport line 120, to the front chamber 50 of the second (right) steering ram 121. This dispensement of hydraulic fluid causes the piston 42 of the second steering ram 121 to extend outwardly from the housing 40 and displace a volume of hydraulic fluid in the rear chamber 52 of the second steering ram. This displaced volume is transferred to the rear chamber 52 of the first (left) steering ram 116. When the steering control valve 100 dispenses hydraulic fluid to the designated front chamber 50, the hydraulic pressure in the non-designated front chamber is bled off to accommodate the transfer of hydraulic fluid from the rear chamber 52 of the second steering ram 121 to the rear chamber 52 of the first steering ram 116, thereby causing inward displacement of the piston 42 in the first (left) steering ram by the constant pressure force in that rear chamber.

Although a preferred embodiment of an external steering system has been described and illustrated comprising an outdrive extension unit 14, it is to be understood, within the scope of this invention, that an external steering system constructed according to principles of this invention can be used with marine outdrive units that do not use an extension unit. In such an embodiment, the steering rams may be attached to the outdrive unit via an adaptor plate that is mounted to the outdrive unit (such as at the connection of the outdrive unit to the bell housing) and comprises mounting brackets at opposite sides of the outdrive unit or may be attached to mounting brackets welded directly to the outdrive unit 12 or housing assembly 16. Each steering ram is attached between a mounting bracket and an adjacent portion of the transom as described above. Additionally, the pressure of the hydraulic fluid routed via the first hydraulic circuit 74 to the rear chamber 52 of each steering ram 38 may be adjusted downward to account for the lessened amount of static and dynamic loading, i.e., the shorter moment arm extending between the propeller hub of the outdrive unit and center of the gimbal ring.

It is desired that the constant pressure directed to the rear chamber of each steering ram be adjustable to accommodate different amounts of static and dynamic forces that can be imposed on the upper steering bearing. Ultimately, the amount of constant pressure directed to each steering ram rear chamber depends on a number of different variables such as the particular brand and/or model of outdrive unit, the particular brand of extension unit, the horsepower of the engine driving the outdrive unit the propeller size and the like. For example, an outdrive unit being used in conjunction with an 8 inch extension unit would require a greater forwardly acting force, i.e., hydraulic fluid routed to the rear chamber of each steering ram at a higher pressure, to counteract the static and dynamic forces imposed on the upper steering bearing than an outdrive unit using a 6 inch extension unit due to the increased moment created between the outdrive unit and the mounting plate. An outdrive unit driven by a 380 horsepower engine would also require a greater forwardly acting force, i.e., hydraulic fluid routed to the rear chamber of each steering ram at a higher pressure, to counteract the static and dynamic forces imposed on the upper steering bearing than an outdrive unit driven by a 200 horsepower engine due to the increased forwardly directed propeller thrust acting on the outdrive unit.

Figure 5:
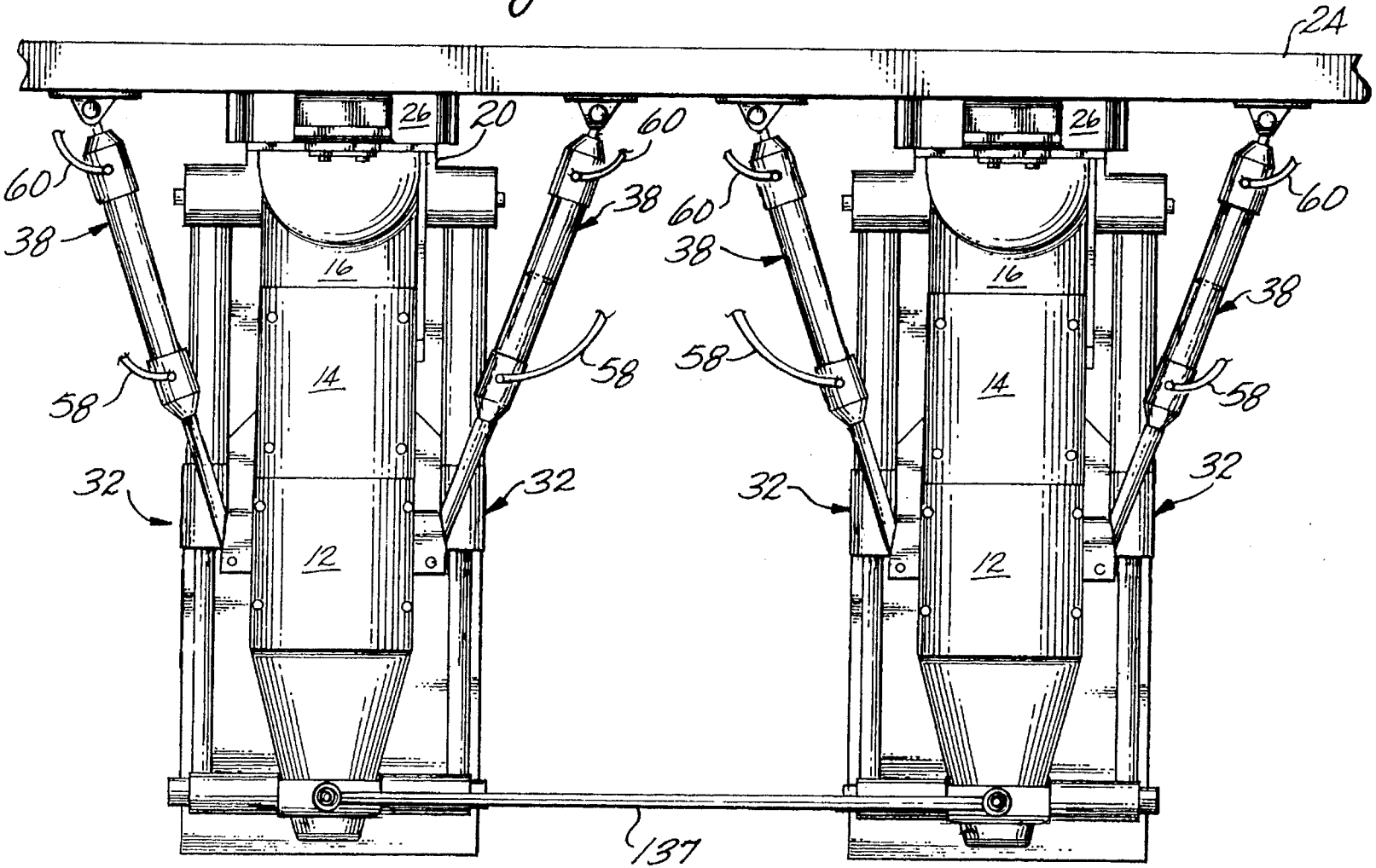
FIG. 5 is a top plan view of a load-relieving external steering system for twin marine outdrive units constructed according to principles of this invention.

It is also understood to be within the scope of this invention that the external steering system may be used to control the steering and provide static and dynamic load relief to more than one marine outdrive unit simultaneously. Referring now to FIG. 5, an alternative embodiment of the load-relieving external steering system is illustrated comprising two or twin outdrive units 12. The attachments between each outdrive unit 12, extension unit 14, driveshaft housing assembly 16, gimbal ring 20, mounting plate 26 and transom 24 is the same as that previously described for the preferred embodiment illustrated in FIGS. 1 and 2. Similarly, the leftward and rightward movement of each outdrive unit is controlled by steering rams 38 that are configured and attached, and the vertical upward and downward movement of the outdrive unit is controlled by tilt rams 32 configured and attached, in the same manner previously described and generally illustrated in FIGS. 1 and 2 for the preferred embodiment. A truss bar 137 is connected between each outdrive unit for purposes of ensuring that the steering action of both outdrive units by the external steering system is synchronized.

Figure 6:
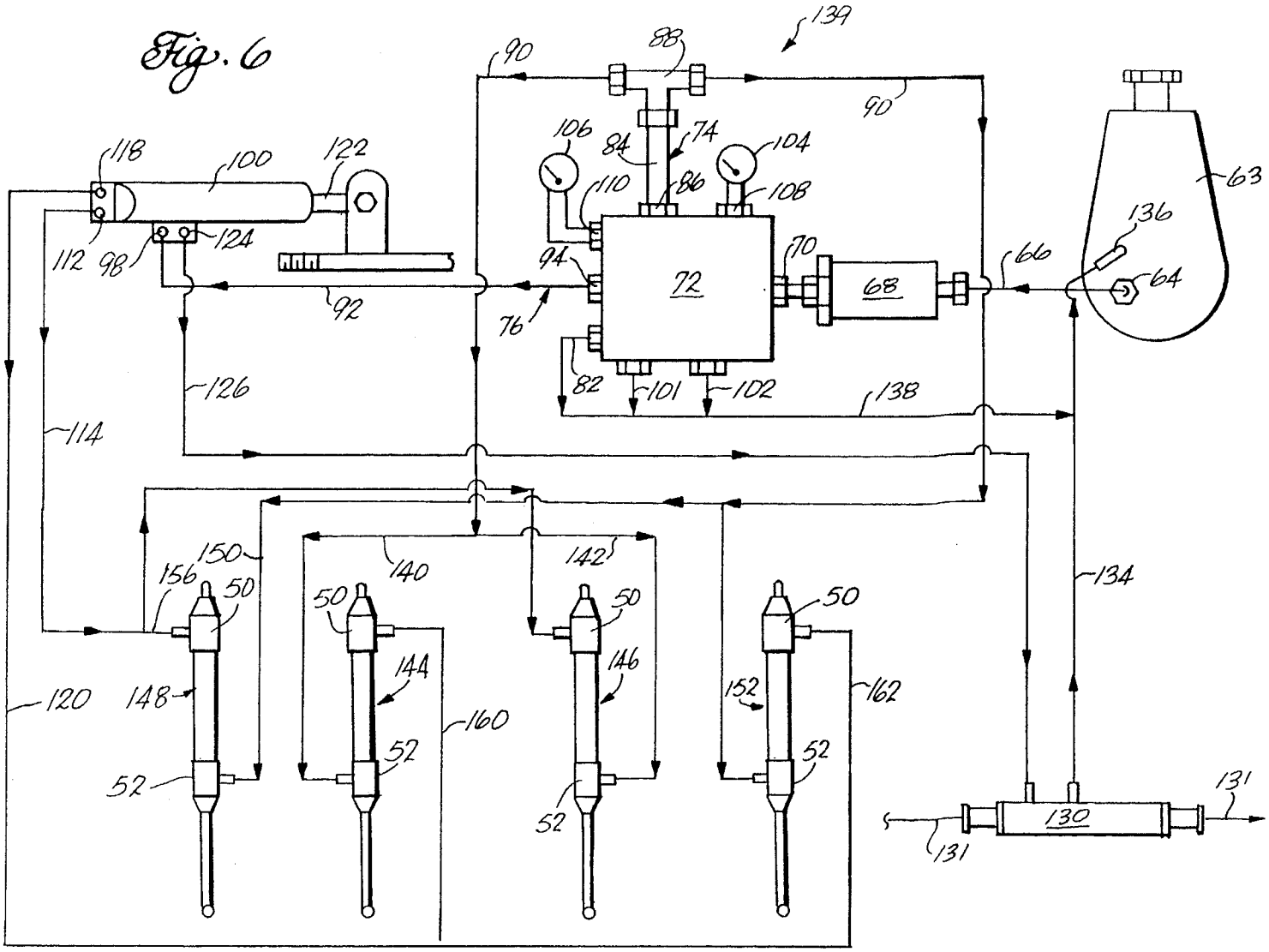
FIG. 6 is a schematic diagram of a hydraulic system for the alternative embodiment of the load-relieving external steering system of FIG. 5.

FIG. 6 illustrates a hydraulic system 139 for the alternative embodiment comprising twin outdrive units 12. The hydraulic system comprises a first and second hydraulic circuit 74 and 76 similar to that described for the preferred embodiment illustrated in FIG. 3, using the same sequence-relief circuit manifold 72 illustrated in FIG. 4. The only difference between the hydraulic systems is that the first and second hydraulic circuits are configured to operate four rather than two steering rams. In the twin outdrive embodiment, the tee fitting 88 attached to the first outlet 86 of the sequence manifold 72 routes hydraulic fluid at a constant pressure in parallel via hydraulic transfer lines 140 and 142 to the rear chamber 52 of a first steering ram 144 mounted to the right side of a first outdrive unit (not shown) and a second steering ram 146 mounted to the left of a second outdrive unit (not shown). A third steering ram 148 is attached to the left side of the first outdrive unit and a hydraulic transfer line 150 is used to route hydraulic fluid to the rear chamber 52 of the third steering ram 148. A fourth steering ram 152 is attached to the right side of the second outdrive unit and a hydraulic transfer line 154 is used to route hydraulic fluid to the rear chamber 52 of the fourth steering ram 152.

The only difference in the second hydraulic circuit 76 of the twin outdrive unit embodiment is that hydraulic fluid from the first outlet port 112 of the steering control valve 100 is routed via hydraulic transport lines 156 and 158 to the front chamber 50 of the third and second steering rams 148 and 146, i.e., the steering rams attached to the left side of each outdrive unit, and the hydraulic fluid from the second outlet port 118 of the steering control valve 100 is routed in via hydraulic transport lines 160 and 162 to the front chamber 50 of the first and fourth steering rams 144 and 152, i.e., the steering rams attached to the right side of each outdrive unit.

The hydraulic system of the twin-outdrive unit embodiment operates the steering rams in the same manner as that previously described for the preferred embodiment and thereby acts to both effect leftward and rightward movement of each outdrive unit and simultaneously impose a predetermined frontwardly directed force on each outdrive unit to counteract the static and dynamic tension forces imposed on the upper steering bearing connecting each outdrive unit.

The foregoing description of presently preferred and other aspects of this invention has been presented by way of illustration and example. It does not present, nor is it intended to present, an exhaustive catalog of all structural and procedural forms by which the invention can be embodied. Variations upon and alterations of the described structures and procedures can be pursued without departing from the fair substance and scope of the invention consistent with the foregoing descriptions, and the following claims which are to be read and interpreted liberally in the context of the state of the art from which this invention has advanced.

What is claimed is:

1. An external steering system for use with a marine outdrive unit disposed rearwardly of a transom of a vessel and comprising:

a first hydraulic steering ram attached to one side of the outdrive unit at one end and attached to an adjacent portion of the transom at an opposite end;

a second hydraulic steering ram attached to an opposite side of the outdrive unit at one end, and attached to an adjacent portion of the transom at an opposite end, wherein each first and second steering ram comprises:

a cylinder forming with a piston a front hydraulic chamber and rear hydraulic chamber;

a piston disposed partially within the cylinder, a drive end portion disposed within the cylinder which with the cylinder defines the front and rear hydraulic chambers;

means for providing hydraulic fluid at a constant pressure to each rear hydraulic chamber to cause each steering ram to impose a forwardly directed force on the outdrive unit;

means for providing hydraulic fluid at a variable pressure to a front hydraulic chamber of a predetermined steering ram to cause an outwardly directed displacement of the piston thereof from the cylinder thereof.

2. A steering system as recited in claim 1 comprising an extension unit interposed between the outdrive unit and the transom, wherein the extension unit comprises mounting brackets at horizontally opposed sides that extend outwardly away from the extension unit, wherein a steering ram is attached to a respective mounting bracket.

3. A steering system as recited in claim 2 wherein an end portion of each cylinder is attached to an adjacent portion of the transom.

4. A steering system as recited in claim 1 wherein means for providing hydraulic fluid at a constant pressure to each rear hydraulic chamber comprises a hydraulic pump, wherein a pressure side of the pump is connected in parallel with the rear chamber of each steering ram.

5. A steering system as recited in claim 1 wherein means for providing hydraulic fluid at a variable pressure comprises:

a hydraulic pump; and a control valve comprising an inlet port connected to a pressure side of the pump, and first and second outlet ports connected with a respective front hydraulic chamber of each steering ram.

6. A steering system as recited in claim 5 wherein the control valve comprises an actuator connected to a mechanical steering mechanism, wherein operator operation of the mechanical steering mechanism causes the control valve to apply hydraulic fluid at a predetermined pressure to a front chamber of a particular steering ram.

7. A steering system as recited in claim 1 comprising means for maintaining the hydraulic fluid applied to the front and rear chamber of each steering ram below a predetermined pressure.

8. A steering system as recited in claim 7 wherein the means for maintaining the hydraulic fluid below a predetermined pressure comprises a sequence relief manifold connected in line with the means for providing hydraulic fluid at a constant pressure and with the means for providing hydraulic fluid at a variable pressure, wherein the manifold comprises at least one check valve set to bypass hydraulic fluid from each front and rear hydraulic chamber to a drain upon reaching a predetermined pressure.

9. A steering system as recited in claim 8 wherein the manifold comprises a first check valve set to bypass hydraulic fluid to a first drain at a first predetermined pressure and a second check valve set to bypass hydraulic fluid to a second drain at a second predetermined pressure greater than the first predetermined pressure.

10. A steering system as recited in claim 1 comprising two outdrive units, wherein a first and second hydraulic steering ram is mounted at opposite sides of each outdrive unit at one end and to adjacent portions of the transom at an opposite end.

11. An external steering system for a marine outdrive unit mounted rearwardly of a vessel transom, the external steering system comprising:

a first hydraulic steering ram comprising a cylinder and a piston disposed partially within the cylinder, wherein an end portion of the piston is attached to one side of the outdrive unit and an end portion of the cylinder is attached to an adjacent portion of the transom;

a second hydraulic steering ram comprising a cylinder and a piston disposed partially within the cylinder, wherein an end portion of the piston is attached to an opposite side of the outdrive unit, and an end portion of the cylinder is attached to an adjacent portion of the transom;

a hydraulic pump for providing hydraulic fluid at a predetermined pressure to each steering ram;

a first hydraulic circuit for distributing hydraulic fluid from the pump at a constant pressure to a rear hydraulic chamber of each steering ram to thereby impose a forwardly directed force on the outdrive unit; and a second hydraulic circuit for distributing hydraulic fluid from the pump at a variable pressure to a front hydraulic chamber of a predetermined steering ram to effect steering of the outdrive unit.

12. A steering system as recited in claim 11 comprising an outdrive extension unit interposed between the outdrive unit and the transom, wherein the extension unit comprises outwardly extending mounting brackets at opposite sides, wherein the end portion of each piston is attached to a respective mounting bracket.

13. A steering system as recited in claim 11 comprising at least one pressure check valve in line with a pressure side of the pump, wherein the check valve is set to keep hydraulic fluid distributed by the first and second hydraulic circuit below a predetermined pressure.

14. A steering system as recited in claim 13 comprising a first and second check valve, wherein the first check valve is set at a first predetermined pressure and the second check valve is set at a second predetermined pressure above the first predetermined pressure.

15. A steering system as recited in claim 13 wherein the check valve is set to provide hydraulic fluid at a predetermined pressure to the first hydraulic circuit to cause the steering rams to impose a forwardly directed force on the outdrive unit of sufficient amount to counteract a rearwardly directed static tension load on an upper steering bearing used to connect the outdrive unit with the transom.

16. A steering system as recited in claim 11 wherein the second hydraulic circuit comprises a control valve comprising:

an inlet port connected to receive hydraulic fluid from a pressure side of the pump;

a first outlet port connected with a front chamber of a first steering ram;

a second outlet port connected with a front chamber of a second steering ram;

an actuator for dispensing hydraulic fluid from the inlet port to either the first or second outlet port; and an manually operated steering mechanism connected to the actuator, wherein movement of the steering mechanism causes the control valve to dispense hydraulic fluid to a predetermined steering ram, thereby effecting steering movement of the outdrive unit and steering of the vessel.

17. A steering system as recited in claim 11 wherein each piston and cylinder is pivotally attached to the outdrive unit and transom in a manner permitting vertical movement of the outdrive unit.

18. A method for steering a marine outdrive unit comprising the steps of:

pressurizing hydraulic fluid;

applying pressurized hydraulic fluid to a rear hydraulic chamber of first and second steering rams connected between opposite sides of an outdrive unit and adjacent portions of a transom;

maintaining the hydraulic fluid applied to the rear chambers at a constant pressure;

applying pressurized hydraulic fluid to a control valve having a first outlet port coupled to a front chamber of the first steering ram, and a second outlet port coupled to a front chamber of the second steering ram; and distributing pressurized hydraulic fluid between the first and second outlet ports in response to operation of a steering control.

19. A method as recited in claim 18 further comprising the step of maintaining the hydraulic pressure applied to the rear chambers of each steering ram and to the control valve below a predetermined pressure.

20. A method as recited in claim 19 further comprising the step of setting the predetermined pressure to impose a forwardly directed force on the outdrive unit to counteract a rearwardly directed tension load on an upper steering bearing used to attached the outdrive unit to the transom.

21. A method for simultaneously relieving a tension load directed on an upper steering bearing used to attach a marine outdrive unit to a transom at a rear portion of a vessel and steering the vessel, the method comprising the steps of:

applying hydraulic fluid at a predetermined constant pressure to a first hydraulic circuit which is hydraulically connected to rear hydraulic chambers of a pair of hydraulic steering rams attached between horizontally opposed sides of the outdrive unit and adjacent portions of the transom, thereby imposing a forwardly directed force to the outdrive unit to relieve a tension load on the upper steering bearing;

applying hydraulic fluid at a second pressure to a second hydraulic circuit which is hydraulically connectible to a front hydraulic chamber of each steering ram; and distributing hydraulic fluid through the second hydraulic circuit at a variable pressure to a front chamber of a predetermined steering ram to overcome the frontwardly directed force and thereby cause horizontal movement of the outdrive unit and steering of the vessel.

22. A method as recited in claim 21 further comprising the step of regulating the fluid pressures applied to the first and second hydraulic circuits so that it they do not exceed a predetermined pressure.

23. A method as recited in claim 21 further comprising the step of controlling the distribution of the hydraulic fluid through the second hydraulic circuit to a front chamber of a predetermined steering ram in response to a manually operated steering mechanism, wherein movement of the steering mechanism in one direction causes hydraulic fluid to be routed to a front chamber of a first steering ram, and movement of the steering mechanism in an opposite direction causes hydraulic fluid to be routed to a front chamber of a second steering ram.

* * * * *